US008041070B2

(12) United States Patent
Kamimura et al.

(10) Patent No.: US 8,041,070 B2
(45) Date of Patent: Oct. 18, 2011

(54) SPEAKER

(75) Inventors: Tomohiko Kamimura, Osaka (JP); Hideo Yuasa, Qingdao (CN)

(73) Assignee: Hosiden Corporation, Yao-shi, Osaka (JP)

( * ) Notice: Subject to any disclaimer, the term of this patent is extended or adjusted under 35 U.S.C. 154(b) by 337 days.

(21) Appl. No.: 12/457,132

(22) Filed: Jun. 2, 2009

(65) Prior Publication Data

US 2009/0296978 A1 Dec. 3, 2009

(30) Foreign Application Priority Data

Jun. 2, 2008 (JP) ..... 2008-144046

(51) Int. Cl.
*H04R 9/06* (2006.01)

(52) U.S. Cl. ..... 381/398; 381/404

(58) Field of Classification Search ..... 381/398, 381/404

See application file for complete search history.

(56) References Cited

U.S. PATENT DOCUMENTS

| | | | | |
|---|---|---|---|---|
| 7,574,013 | B2 * | 8/2009 | Funahashi et al. | 381/397 |
| 7,929,724 | B2 * | 4/2011 | Funahashi | 381/398 |
| 2001/0043712 | A1 * | 11/2001 | Kuze et al. | 381/396 |
| 2004/0218778 | A1 * | 11/2004 | Weisman | 381/396 |
| 2004/0218779 | A1 * | 11/2004 | Fukuyama et al. | 381/409 |
| 2006/0147066 | A1 * | 7/2006 | Horigome et al. | 381/182 |
| 2008/0053745 | A1 * | 3/2008 | Tada et al. | 181/165 |
| 2008/0212808 | A1 * | 9/2008 | Omoda | 381/191 |
| 2009/0052724 | A1 * | 2/2009 | Umemura | 381/398 |
| 2009/0285439 | A1 * | 11/2009 | Yuasa et al. | 381/412 |
| 2009/0285440 | A1 * | 11/2009 | Yuasa et al. | 381/412 |
| 2009/0296979 | A1 * | 12/2009 | Kamimura et al. | 381/412 |
| 2011/0123061 | A1 * | 5/2011 | Kamimura et al. | 381/412 |

FOREIGN PATENT DOCUMENTS

| | | | |
|---|---|---|---|
| JP | 1001 3992 | A | 1/1998 |
| JP | 2000 209633 | A | 7/2000 |
| JP | 2001 309489 | A | 11/2001 |

* cited by examiner

*Primary Examiner* — Savitr Mulpuri
(74) *Attorney, Agent, or Firm* — Bacon & Thomas, PLLC

(57) ABSTRACT

The invention relates to a small speaker. A speaker 1 comprises: a magnetic circuit 3 having a yoke 7, a magnet 15, and a pole piece 16; a vibration system 4 having a voice coil 18 and diaphragm 19 which are joined to each other through a voice coil bobbin 23; and a frame 2 which holds the magnetic circuit 3 and the vibration system. The voice coil is placed in a magnetic gap 17. In the speaker, dampers 26 which are extended respectively from a plurality of places of an opening side end portion of the voice coil bobbin are disposed, and tip end portions of said dampers are bonded and fixed to the frame. The voice coil bobbin is supported from the lower side. The resistance to input is improved without impairing the thinness of the speaker 1, and while suppressing the increase of the production cost.

5 Claims, 11 Drawing Sheets

SPEAKER

TECHNICAL FIELD

The present invention relates to a small speaker (dynamic speaker) which can be used in a portable telephone or the like.

BACKGROUND ART

Conventionally, a small speaker (dome type) is known in which a damper having a usual structure employed in a large speaker (cone type) to be used in a stereo unit or the like is employed to improve the resistance to input (for example, see Patent Literatures 1 to 3).

A damper is placed between an outer peripheral portion (edge portion) of a diaphragm, and a frame which is disposed below the outer peripheral portion, the outer peripheral edge portion is bonded and fixed to the frame, and the inner peripheral edge portion is bonded and fixed to the outer face of a voice coil bobbin between a voice coil and a middle portion (center portion) of the diaphragm which is above the voice coil, whereby the voice coil is held at a correct position so as to perform accurate piston motion.

PRIOR ART LITERATURE

Patent Literature

[Patent Literature 1] Japanese Patent Application Laying-Open No. 10-13992

[Patent Literature 2] Japanese Patent Application Laying-Open No. 2000-209693

[Patent Literature 3] Japanese Patent Application Laying-Open No. 2001-309489

SUMMARY OF THE INVENTION

Problem to be Solved by the Invention

A small speaker is requested to be further miniaturized and thinned. However, there is a problem in that a conventional damper which supports the outer face of a voice coil bobbin in the same manner as in a large speaker impedes the thinning of a speaker.

A diaphragm must vibrate while pushing the air. By contrast, a conventional damper is requested to have high air permeability. In the case where a voice coil bobbin is formed integrally with a middle portion of a diaphragm, therefore, the damper cannot be formed integrally with the voice coil bobbin. Also in the case where a voice coil bobbin is formed separately from a middle portion of a diaphragm, the damper cannot be formed integrally with the voice coil bobbin as far as the damper supports the outer face of the voice coil bobbin. Consequently, a damper is formed as a single component, and the number of components of a speaker and the number of assembly steps are increased, thereby causing a problem in that the production cost is increased.

It is a problem to be solved by the invention to improve the resistance to input by a damper without impairing the thinness of a small speaker, and while suppressing the increase of the production cost.

Means for Solving the Problem

According to the invention, in a speaker comprising: a magnetic circuit having a yoke, a magnet, and a pole piece; a vibration system having a voice coil and diaphragm which are joined to each other through a voice coil bobbin; and a frame which holds the magnetic circuit and the vibration system, the voice coil being placed in a magnetic gap, dampers which are extended respectively from a plurality of places of an opening side end portion of the voice coil bobbin are disposed, tip end portions of the dampers being bonded and fixed to the frame.

In the invention, preferably, the frame is formed into a yoke-integral type by applying a pressing process on one sheet-like metal material to form a shallow bottomed tubular shape, and by cutting and raising at least two places of a bottom plate of the frame to form a bottomed frame-like yoke, the dampers are extended to an outside of the yoke through gaps between sidewalls of the yoke, and tip end portions of the dampers are bonded and fixed to the bottom plate of the frame which is in a periphery of a bottom plate of the yoke.

In the invention, preferably, an annular damper coupling plate which couples the tip end portions of the dampers together may be disposed. In this case, the damper coupling plate may be formed separately from or integrally with the dampers, and the dampers are bonded and fixed to the frame through the damper coupling plate. In the case where the damper coupling plate is formed separately from the dampers, the tip end portions of the dampers are bonded and fixed to the damper coupling plate by a double-sided adhesive tape or an adhesive agent.

Effects of the Invention

According to the invention, the voice coil bobbin is supported from the lower side by the dampers, and hence it is not necessary to additionally ensure a space for installing the dampers. Therefore, the resistance to input can be improved without impairing the thinness of a small speaker.

The air flows through the gaps between the dampers, and hence the dampers themselves are not required to have air permeability. Moreover, the dampers support from the lower side the voice coil bobbin, and hence the dampers can be formed integrally with the voice coil bobbin, irrespective of whether the voice coil bobbin is formed separately from or integrally with the diaphragm. Therefore, the resistance to input can be improved while suppressing the increase of the production cost of a small speaker.

When the tip end portions of the dampers are coupled together by the annular damper coupling plate, the stability in the configuration in which the voice coil bobbin is supported from the lower side by the dampers is enhanced, and the bonding of the dampers to the frame can be performed with high workability. Therefore, the mass productivity can be enhanced.

MODE FOR CARRYING OUT THE INVENTION

Hereinafter, Embodiments 1 to 3 of the invention will be described with reference to the drawings.

Embodiment 1

Figure 1:
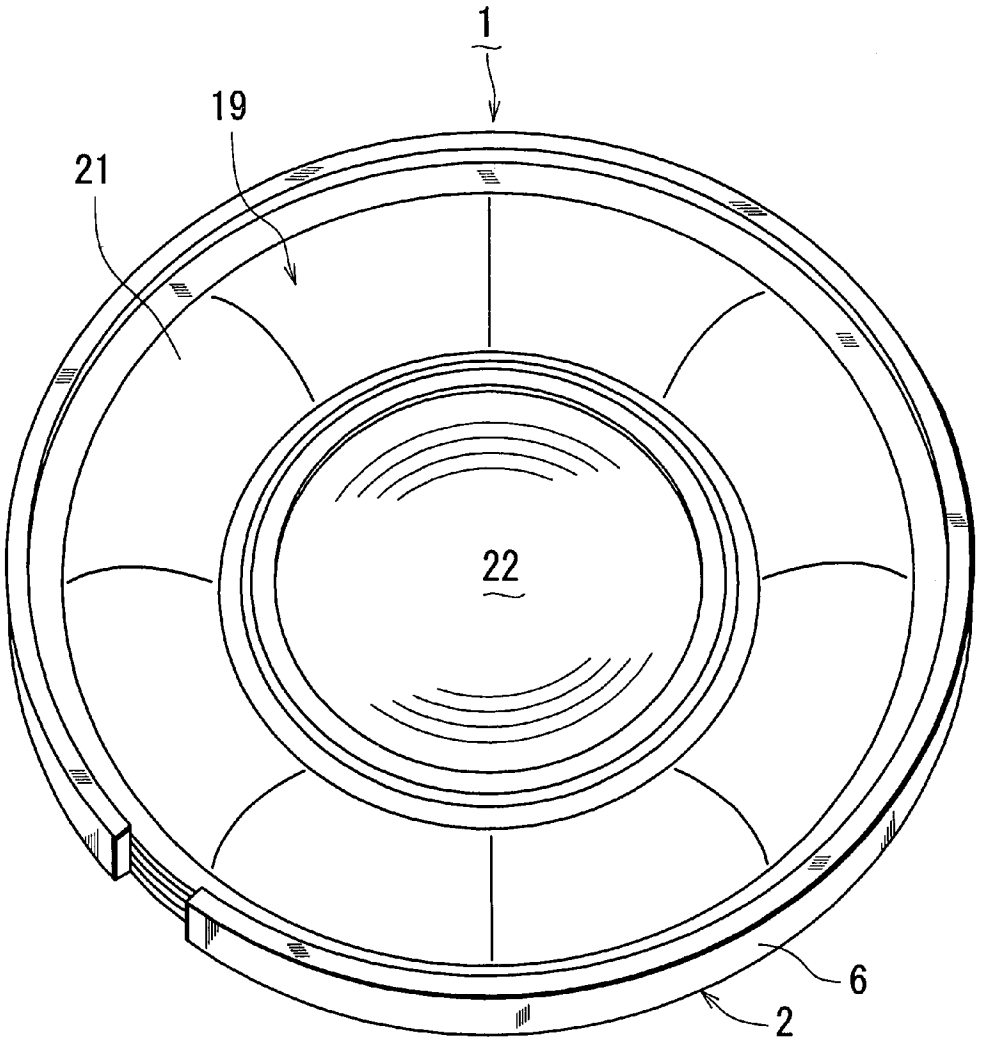
FIG. 1 is a plan view of a speaker of Embodiment 1 of the invention.
Figure 2:
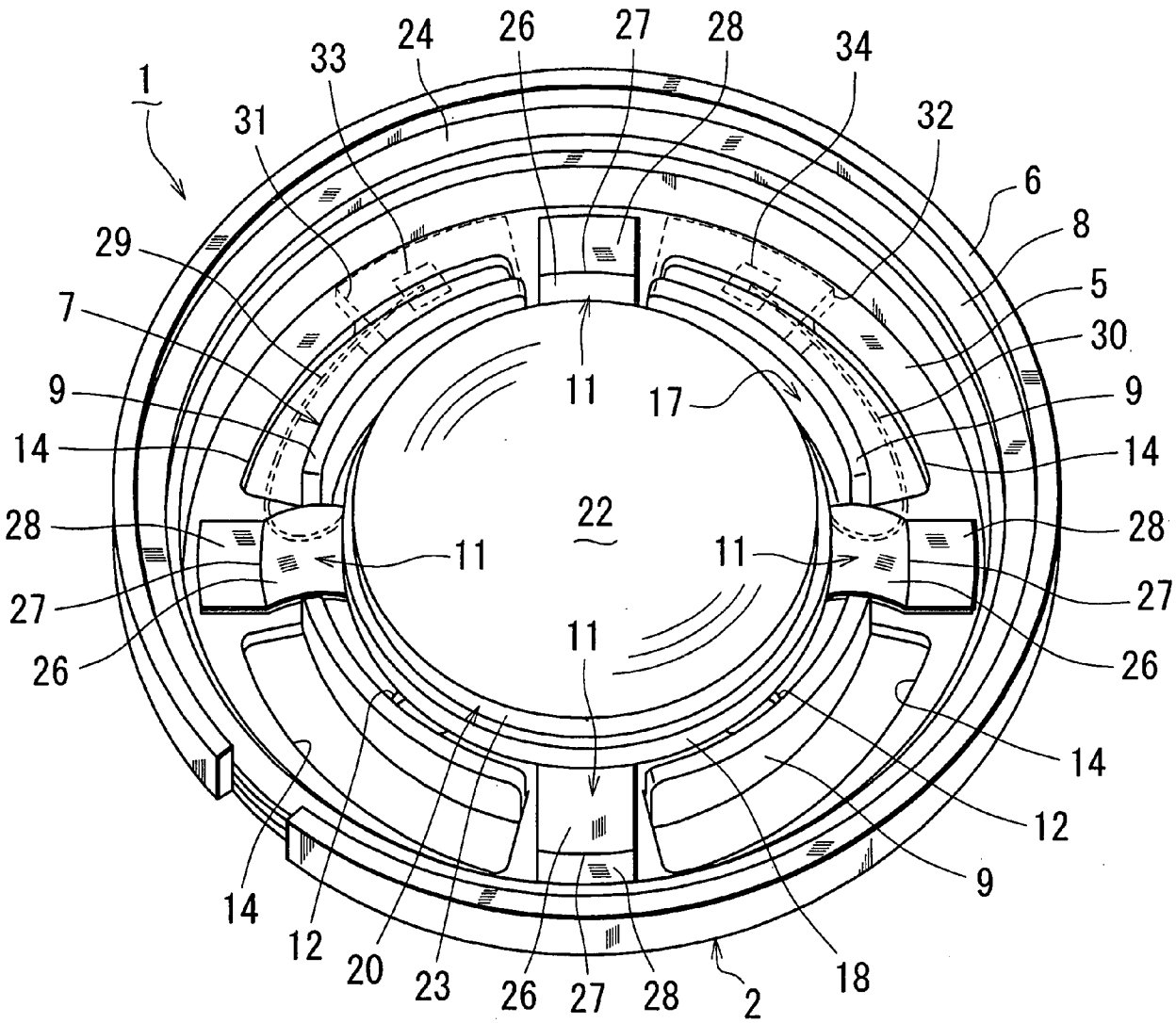
FIG. 2 is a plan view of a state where an edge portion of a diaphragm of the speaker of Embodiment 1 of the invention is made transparent.
Figure 3:
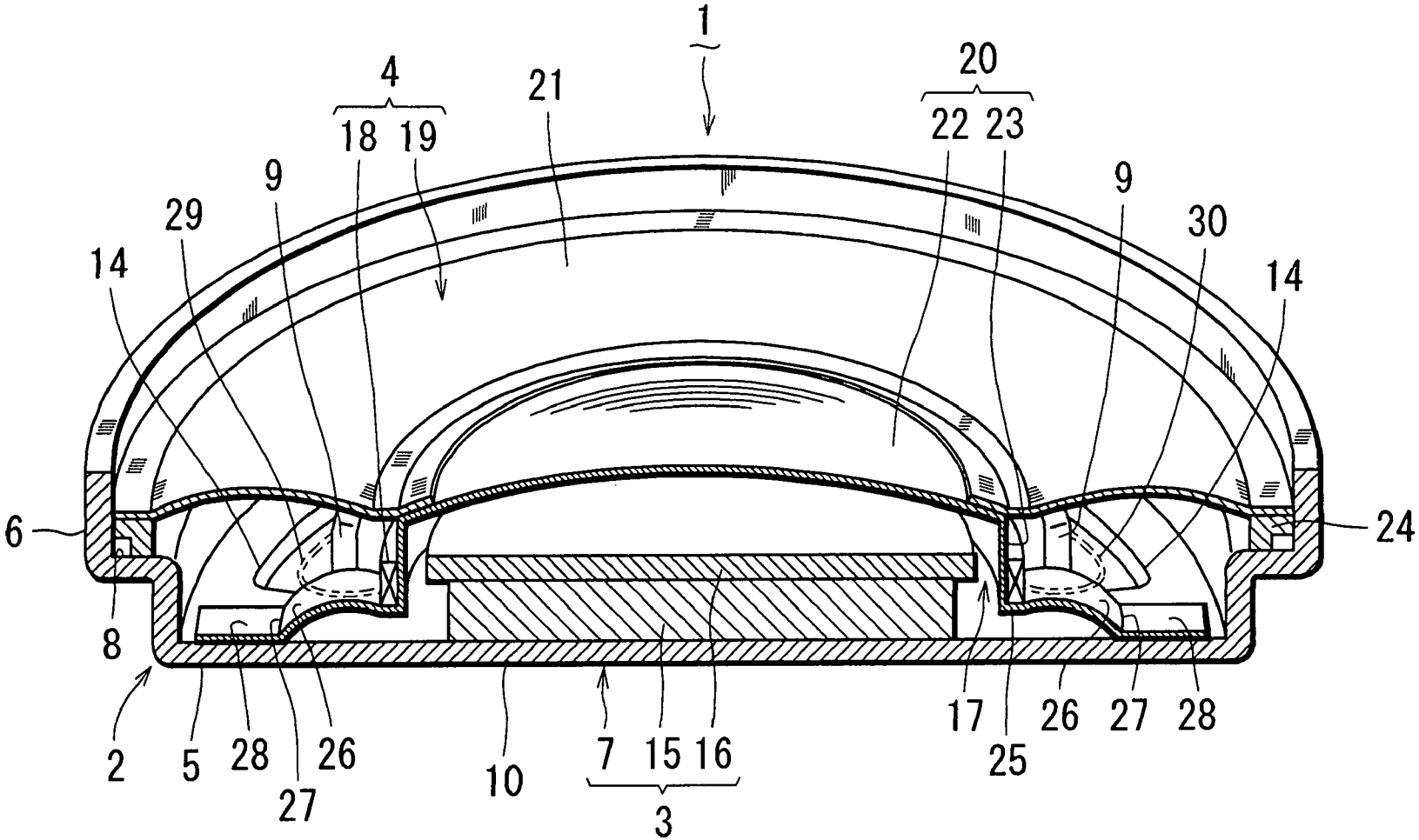
FIG. 3 is a sectional view of the speaker of Embodiment 1 of the invention.
Figure 4:
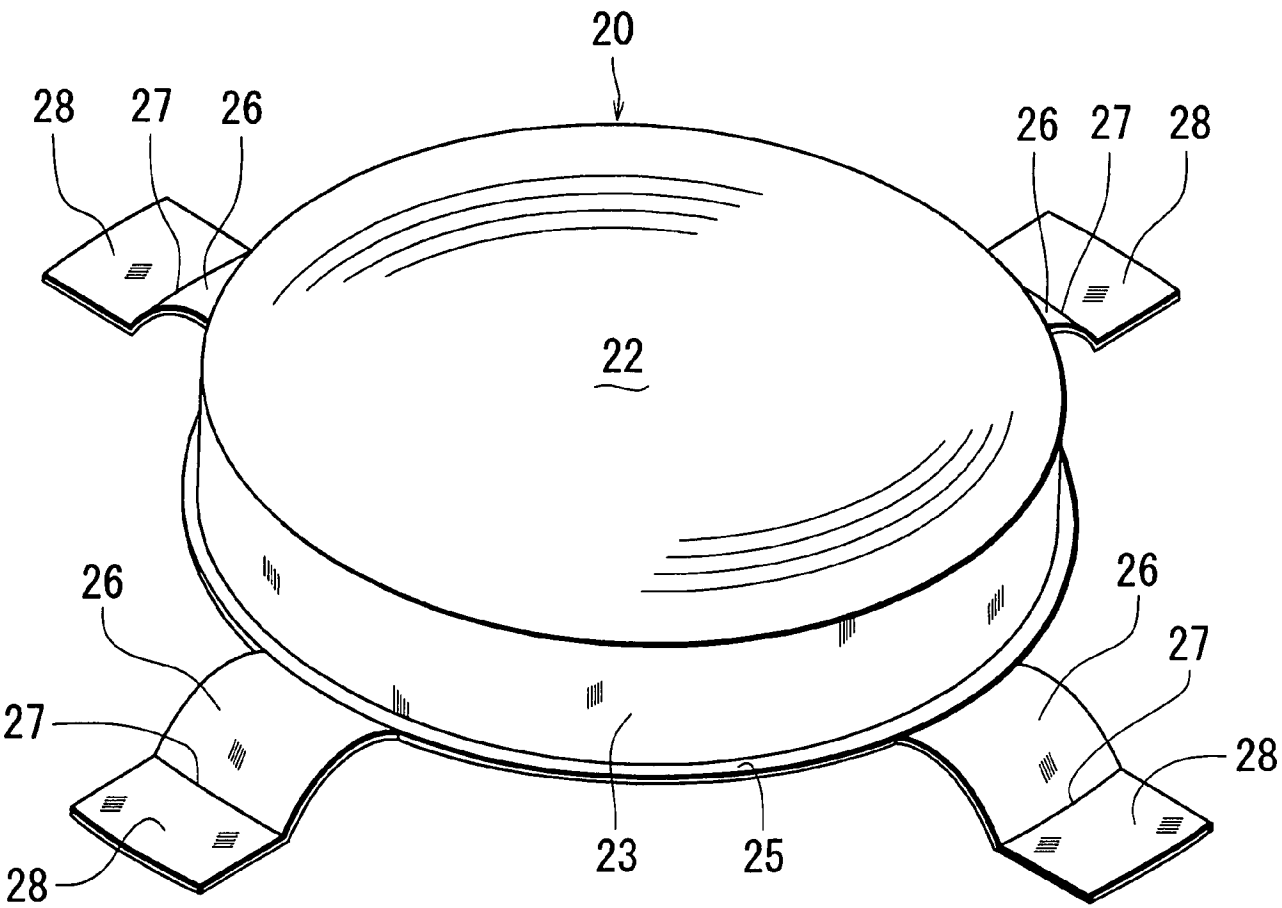
FIG. 4 is an external view of a center portion of the diaphragm of the speaker of Embodiment 1 of the invention.

A speaker of Embodiment 1 is shown in FIGS. 1 to 3. FIG. 1 is a plan view, FIG. 2 is a plan view of a state where an edge portion of a diaphragm is made transparent, and FIG. 3 is a sectional view. FIG. 4 is an external view of a center portion of the diaphragm of the speaker of Embodiment 1.

The speaker 1 is of the round type, and comprises a circular frame 2, a magnetic circuit 3 (driving system), and a vibration system 4.

The frame 2 is configured as a yoke-integral type, and formed into a shallow bottomed tubular shape which is configured by applying a pressing process (drawing process) on one sheet-like metal material to dispose a circular bottom plate 5 and a sidewall 6 that is raised from the outer peripheral edge of the plate. Cutting and bending processes are performed on the bottom plate 5 to raise four outer side portions of the bottom plate 5, whereby a circular bottomed frame-like yoke 7 which is concentric with and slightly smaller than the frame 2 is integrally formed.

The sidewall 6 is stepped, has a circular annular step face 8 which is parallel to the bottom plate 5, and is formed so that a large diameter of the side above the step face 8 is slightly larger than that of the side below the step face.

In the yoke 7, four yoke sidewalls 9 which are arcuately curved, and which are opposed to the inside of the sidewall 6 across a predetermined space, and a circular yoke bottom plate 10 which is configured by a middle portion of the bottom plate 5 that is inside the yoke side-walls 9 are disposed.

The inside of the yoke 7 communicates with an outer side portion in the frame 2 in the periphery of the yoke 7, through four gaps 11 which are formed between the yoke sidewalls 9.

In the yoke bottom plate 10, jig insertion ports 12 each formed by a small circular hole are opened respectively in four places which are at substantially regular intervals on the same circumference of a circle centered at the center of the yoke bottom plate 10. During assembling of the speaker 1, jigs (not shown) for positioning and holding a magnet 15 and pole piece 16 which will be described later, in the yoke 7 can be inserted from the lower side of the yoke 7 into the yoke 7 through the jig insertion ports 12.

Four arcuate openings 14 which are formed by cutting and raising the yoke sidewalls 9 are disposed in the bottom plate 5. The openings 14 are used as rear sound holes for the speaker 1.

The magnetic circuit 3 is configured by: the yoke 7; the magnet 15 which is a columnar permanent magnet bonded and fixed onto the yoke bottom plate 10 while being centered thereon; and the pole piece 16 configured by a circular metal plate which is bonded and fixed onto the magnet 15 while being centered thereon.

In the magnetic circuit 3, a circular magnetic gap 17 is formed between the pole piece 16 and the yoke sidewalls 9.

The vibration system 4 is configured by a cylindrical voice coil 18 in which a conductor wire is wound, and a diaphragm 19 to which the voice coil 18 is attached.

The diaphragm 19 is made of a resin film or a metal film, and configured by two pieces, or a center portion 20 and an edge portion 21.

The center portion 20 has a ceiled cylindrical shape. The ceiling portion configures a hemispherical dome portion 22 in which the upper face is convex and the lower face is concave (or an inverted hemispherical dome portion in which the upper face is concave and the lower face is convex). The trunk portion configures a cylindrical voice coil bobbin 23. The dome portion 22 and voice coil bobbin 23 which constitute a dome diaphragm are integrally formed.

The edge portion 21 has a circular annular shape. An inner peripheral edge portion is overlappingly bonded and fixed to an outer peripheral edge portion of the dome portion 22, so that the edge portion 21 is formed integrally with the periphery of the dome portion 22.

An outer peripheral edge portion of the edge portion 21 is bonded and fixed to the step face 8 of the sidewall 6 through a circular annular diaphragm ring 24 which has an L-like section shape, and that of the dome portion 22 is joined to an outer portion of the frame 2, so that the dome portion 22 is always held to a correct position. The edge portion follows the motion of the dome portion 22 without impeding the motion of the dome portion, and blocks a sound of the back face of the dome portion 22.

The voice coil bobbin 23 hangs from the outer peripheral edge portion of the dome portion 22, an opening side end portion (lower end portion) is inserted into the magnetic gap 17, and the voice coil 18 which is wound therearound is placed in the magnetic gap 17. The piston motion (vertical motion) of the voice coil 18 is transmitted to the dome portion 22.

If the dome portion 22 and the voice coil bobbin 23 are formed separately from each other, a step of bonding them is necessary. In the embodiment, they are integrally formed, and hence such a step is not required. Furthermore, the center portion 20 and the edge portion 21 are formed separately from each other, and hence they can be formed by films of different materials, respectively, so that necessary characteristics can be easily obtained. Particularly, the voice coil bobbin 23 is requested to have characteristics such as: high rigidity which maintains the voice coil 18 to have a true circular shape in the narrow magnetic gap 17, and which joins the voice coil 18 with the dome portion 22 without causing a loss; flexibility which prevents resonance from occurring; and heat resistance which resists the heat of the voice coil 18. Therefore, polyetherimide is used as the film material of the center portion 20.

The voice coil bobbin 23 is formed to have an L-like section shape, and has a circular annular flange portion 25 which is extended from the opening side end portion of the voice coil bobbin 23 to the outer side of the voice coil bobbin 23 in a plane perpendicular to the axis of the voice coil bobbin 23. A lower end portion of the voice coil 18 is bonded and fixed to the flange portion 25. The inner face and lower end of the voice coil 18 are held by the voice coil bobbin 23, whereby the voice coil 18 can be prevented from being loosened or dropping from the voice coil bobbin 23.

A plurality of dampers 26 are integrally formed on the voice coil bobbin 23. In order to allow the dampers 26 to be projected through the gaps 11 to the outer side of the frame 2 in the periphery of the yoke 7, the dampers are configured by rectangular extended pieces which are radially extended from four places of the flange portion 25 which are at regular intervals, to the radially outward side of the voice coil bobbin 23 in a plane perpendicular to the axis of the voice coil bobbin 23. In a tip end portion of each of the dampers 26, a bonding portion 28 is formed through a fold line 27.

In the dampers 26, the bonding portions 28 are bonded and fixed to portions which are in the outer side of the bottom plate 5 in the periphery of the yoke bottom plate 10, and which are between the openings 14, whereby the dampers 26 are arcuately bent to be provided with a spring property. As a result, the dampers 26 do not support the outer face of the voice coil bobbin 23, but support from the lower side the voice coil bobbin, hold the voice coil 18 to a correct position so that the voice coil can perform accurate piston motion, and follows motion of the voice coil 18 without impeding the motion.

Lead wires 29, 30 of the voice coil 18 are drawn out in a U-like manner from two places which are in a lower end portion of the voice coil 18, and which correspond to the two gaps 11 that are opposed to each other in the lateral direction of the speaker shown in FIG. 2, respectively.

In the frame 2, plate-like insulators 31, 32 are fixed so as to partly close the openings 14 which are in the outer side of the bottom plate 5 in the periphery of the yoke bottom plate 10, and which are upward arcuately bent from the above-described two gaps 11.

The insulators 31, 32 are fixed to the frame 2 by passing fixing pins (not shown) which are raised from the bottom plate 5 by a burling process, through the insulators 31, 32 via through holes (not shown), and collapsing tip end portions of the fixing pins. Alternatively, the fixation may be performed by using an adhesive agent.

Contact pads 33, 34, and external connection terminals (not shown) which are conductive with the contact pads 33, 34, and which are configured by a plate spring or a coil spring are integrally formed in the insulators 31, 32 by insert molding. The contact pads 33, 34 are substantially flushly embedded in the upper faces of the insulators 31, 32 to be exposed into the frame 2. The external connection terminals are projected to the lower side of the frame 2 (the outside of the speaker 1) from the openings 14 which are below the insulators 31, 32.

The lead wires 29, 30 drawn out from the voice coil 18 are further drawn out from the above-described two gaps 11 toward the outer side in the frame 2 which is in the periphery of the yoke 7, and then a wire laying process of laying the lead wires from the upper side of the speaker to the contact pads 33, 34 to which the lead wires are to be connected is performed. Thereafter, the ends of the lead wires 29, 30 are spot-welded (or soldered) to the contact pads 33, 34 to which the lead wires are to be connected, to be electrically connected to the external connection terminals which are conductive with the connected contact pads 33, 34. In this case, slacks are formed in the lead wires 29, 30 so that the lead wires 29, 30 do not impede the motion of the voice coil 18, and are not broken when a large current is input.

A shallow ceiled cylindrical baffle (not shown) which is configured by a metal sheet, and which has a front sound hole in the top face is fittingly fixed to the open upper face of the frame 2 (the front face of the speaker 1).

As described above, the speaker 1 comprises: the magnetic circuit 3 having the yoke 7, the magnet 15, and the pole piece 16; the vibration system 4 having the voice coil 18 and diaphragm 19 which are joined to each other through the voice coil bobbin 23; and the frame 2 which holds the magnetic circuit 3 and the vibration system 4, and the voice coil 18 is placed in the magnetic gap 17. In addition, the dampers 26 which are extended from the plural places of the opening side end portion of the voice coil bobbin 23, and in which the tip end portions are bonded and fixed to the frame 2 are disposed. The frame 2 is formed into a bottomed tubular shape which is configured by applying a pressing process on one sheet-like metal material. The circular bottomed frame-like yoke 7 is formed by performing a cutting and raising process on at least two places of the bottom plate 5 of the frame 2, and configured as a yoke-integral type. The dampers 26 are extended to the outside of the yoke 7 through the gaps between the yoke sidewalls 9. The tip end portions of the dampers are bonded and fixed to the bottom plate 5 of the frame 2 which is in the periphery of the yoke bottom plate 10.

When an audio signal is supplied from an external circuit to the voice coil 18 through the pair of external connection terminals, the interaction between the magnetic field generated in the magnetic circuit 3 and the current flowing through the voice coil 18 causes the voice coil 18 to vertically vibrate, and, in accordance with this, the dome portion 22 (dome type diaphragm) is vertically vibrated to cause the surrounding air to vibrate, thereby generating a sound.

In this case, the dampers 26 correspond together with the edge portion 21 to the spring of the vibration system 4, reduce the vibration system stiffness (S0), and lower the minimum resonant frequency (f0) (make a low pitch sound to be easily generated). In spite that the speaker 1 is small, therefore, a high resistance to input is attained while the distortion is suppressed, and a high sound quality (low pitch sound) is maintained.

The dampers 26 support from the lower side the voice coil bobbin 23. Therefore, it is not necessary to additionally ensure a space for installing the dampers 26, and a high resistance to input is obtained without impairing the thinness of the small speaker 1.

The dampers 26 allow the air to flow through the gaps between the dampers 26, and hence the dampers 26 themselves are not required to have air permeability. Moreover, the dampers 26 support from the lower side the voice coil bobbin 23, and hence the dampers 26 can be formed integrally with the voice coil bobbin 23, irrespective of whether the voice coil bobbin 23 is formed separately from or integrally with the dome portion 22. Therefore, a high resistance to input can be obtained while suppressing the increase of the production cost of the small speaker 1.

Embodiment 2

Figure 5:
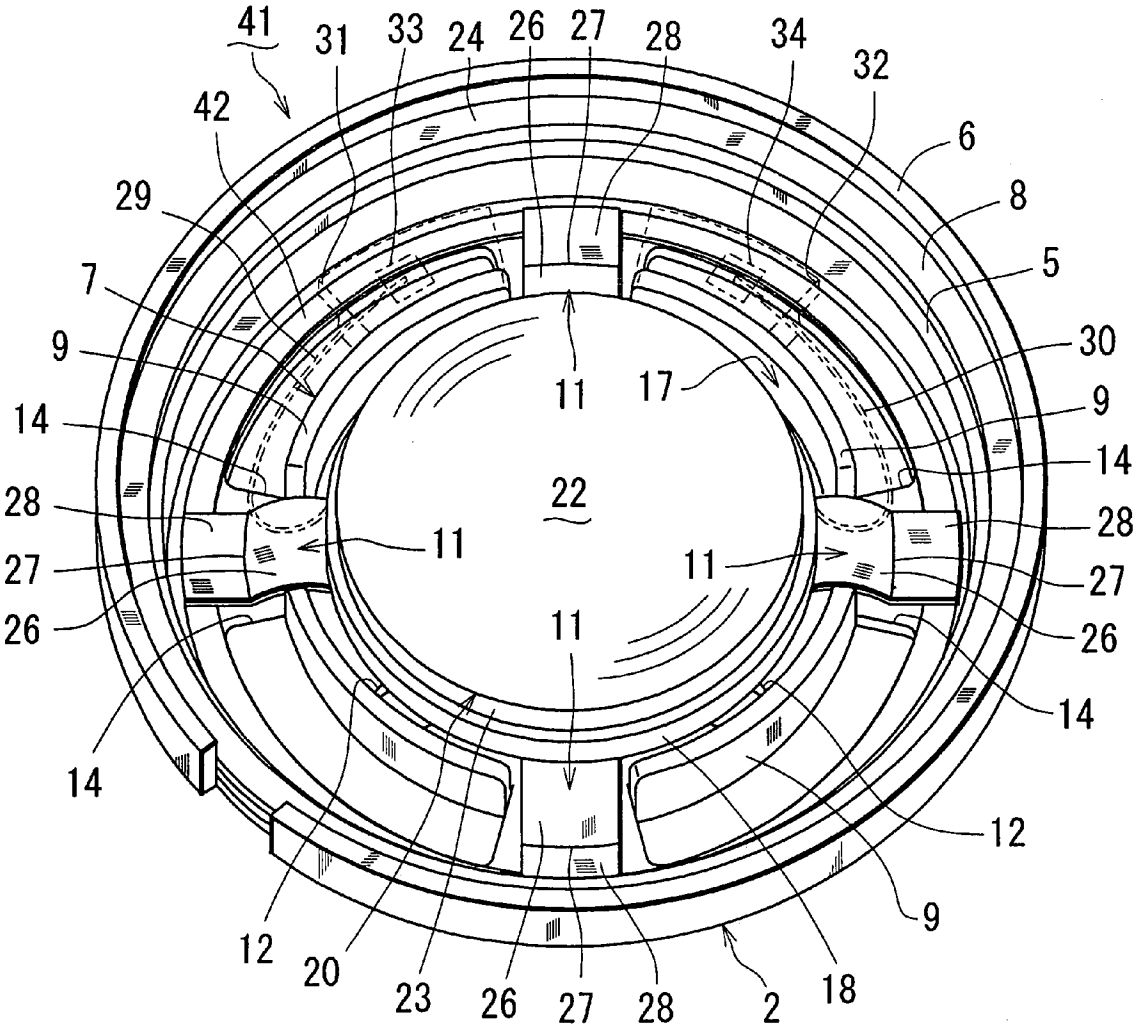
FIG. 5 is a plan view of a state where an edge portion of a diaphragm of a speaker of Embodiment 2 of the invention is made transparent.
Figure 6:
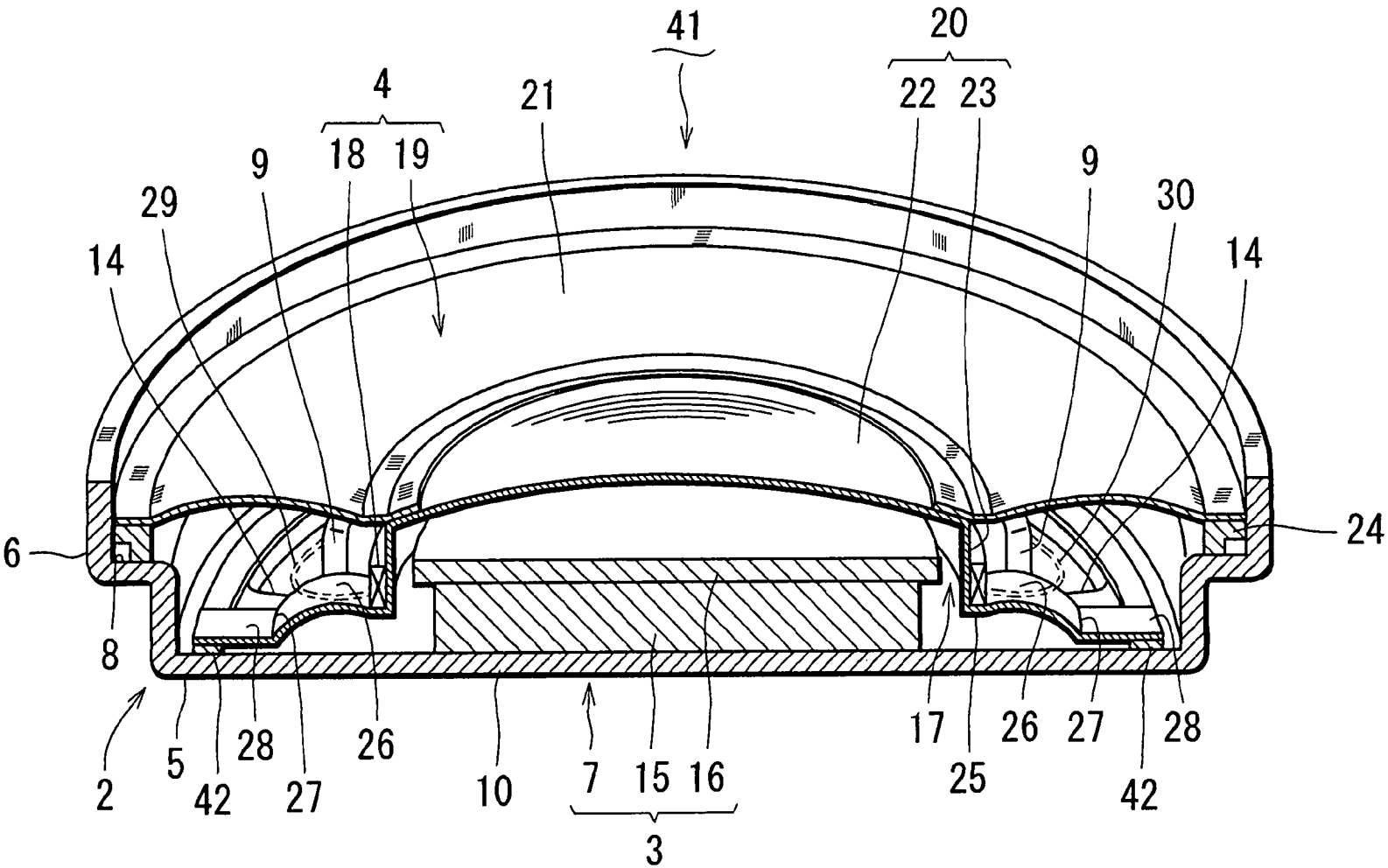
FIG. 6 is a sectional view of the speaker of Embodiment 2 of the invention.
Figure 7:
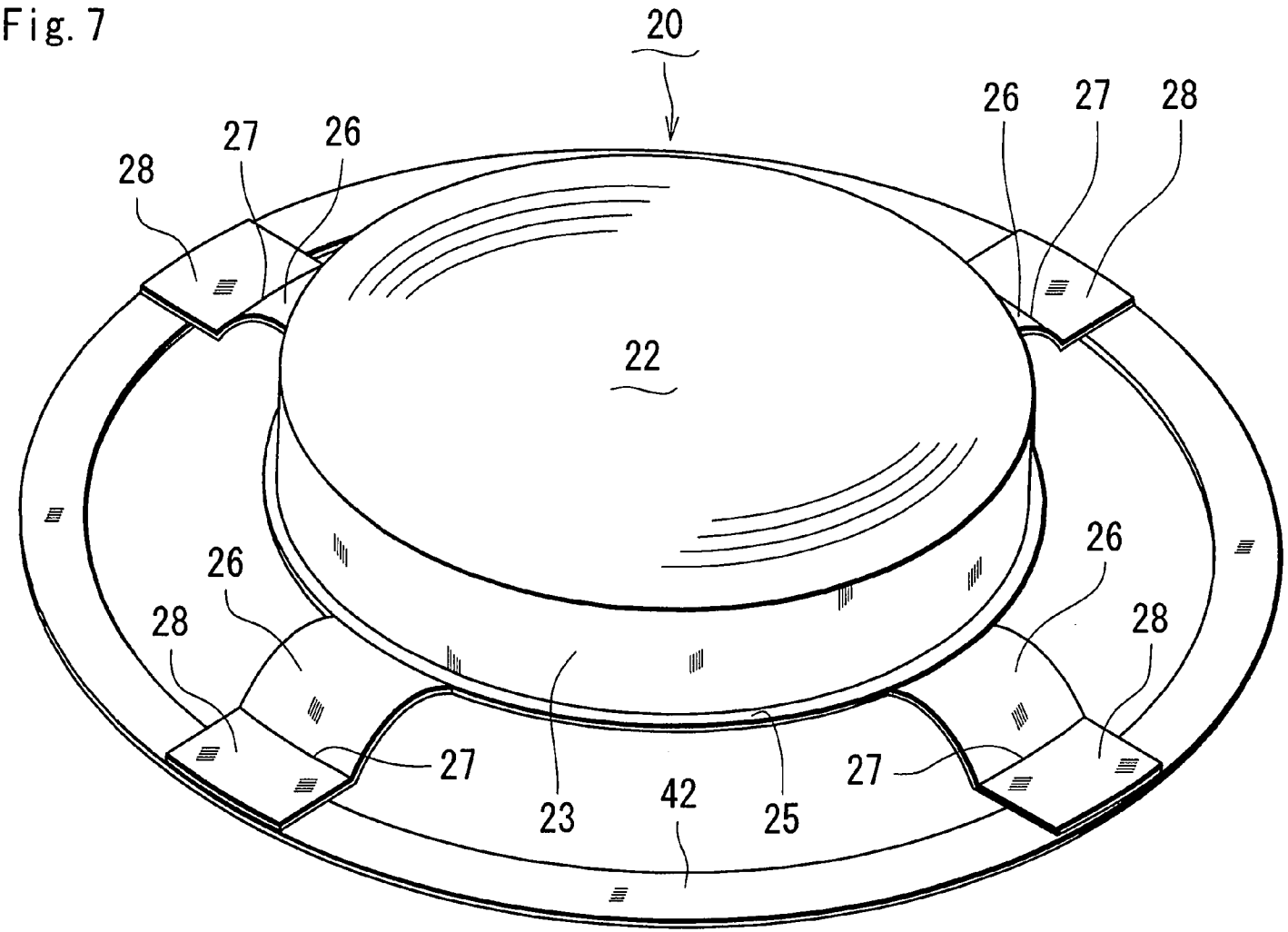
FIG. 7 is an external view of a center portion of the diaphragm of the speaker of Embodiment 2 of the invention.

A speaker of Embodiment 2 is shown in FIGS. 5 and 6. FIG. 5 is a plan view of a state where an edge portion of a diaphragm is made transparent, and FIG. 6 is a sectional view. FIG. 7 is an external view of a center portion of the diaphragm of the speaker of Embodiment 2. The components which are identical with those of the speaker of Embodiment 1 are denoted by the same reference numerals, and their detailed description is omitted.

The speaker 41 shown in FIGS. 5 and 6 is different from the speaker 1 shown in FIGS. 1 to 3 in that an annular damper coupling plate 42 which couples the bonding portions 28 of the dampers 26 together is disposed.

As shown in FIG. 7, the damper coupling plate 42 is disposed separately from the dampers 26, and the lower faces of the bonding portions 28 of the dampers 26 are bonded and fixed to the upper face of the damper coupling plate 42 by a double-sided adhesive tape or an adhesive agent, so that the bonding portions 28 of the dampers 26 are coupled to one another. In this case, the damper coupling plate 42 is in a plane perpendicular to the axis of the voice coil bobbin 23, and the center of the damper coupling plate 42 is on the axis of the voice coil bobbin 23.

As shown in FIGS. 5 and 6, the lower face of the damper coupling plate 42 is bonded and fixed to the outermost side portion which is outside the four arcuate openings 14 of the bottom plate 5, by a double-sided adhesive tape or an adhesive agent, and the bonding portions 28 of the dampers 26 are bonded and fixed to the bottom plate 5.

As described above, the tip end portions (bonding portions 28) of the dampers 26 are coupled to one another by the damper coupling plate 42, whereby the stability in the configuration in which the voice coil bobbin 23 is supported from the lower side by the dampers 26 is enhanced, and the bonding of the dampers 26 to the frame (bottom plate 5) can be performed with high workability. Therefore, the mass productivity can be enhanced.

Since the damper coupling plate 42 is disposed separately from the dampers 26, the plate may be formed by a film of a material which is identical with or different from that of the center portion 20.

Figure 8:
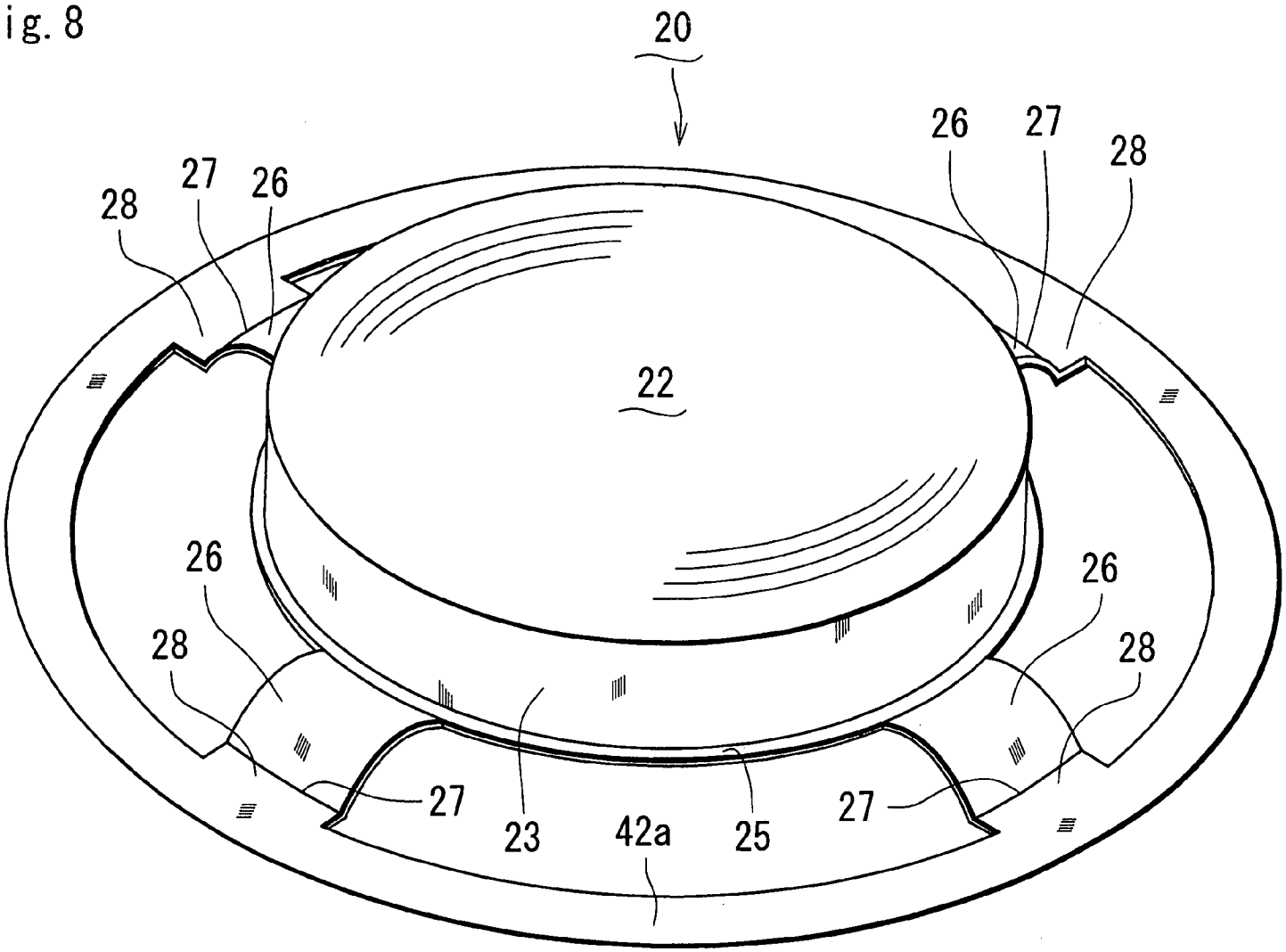
FIG. 8 is an external view of another center portion of the diaphragm of the speaker of Embodiment 2 of the invention.

Alternatively, the damper coupling plate may be formed integrally with the dampers 26. In the alternative, the arcuate shapes of the dampers 26 are formed in a molding process. Furthermore, the bonding portions 28 of the dampers 26 are formed continuously with the inner peripheral edge of the damper coupling plate, and the bonding portions 28 of the dampers 26 and the damper coupling plate are in the same plane. FIG. 8 shows a damper coupling plate 42*a* which is integrated with the dampers 26.

Embodiment 3

Figure 9:
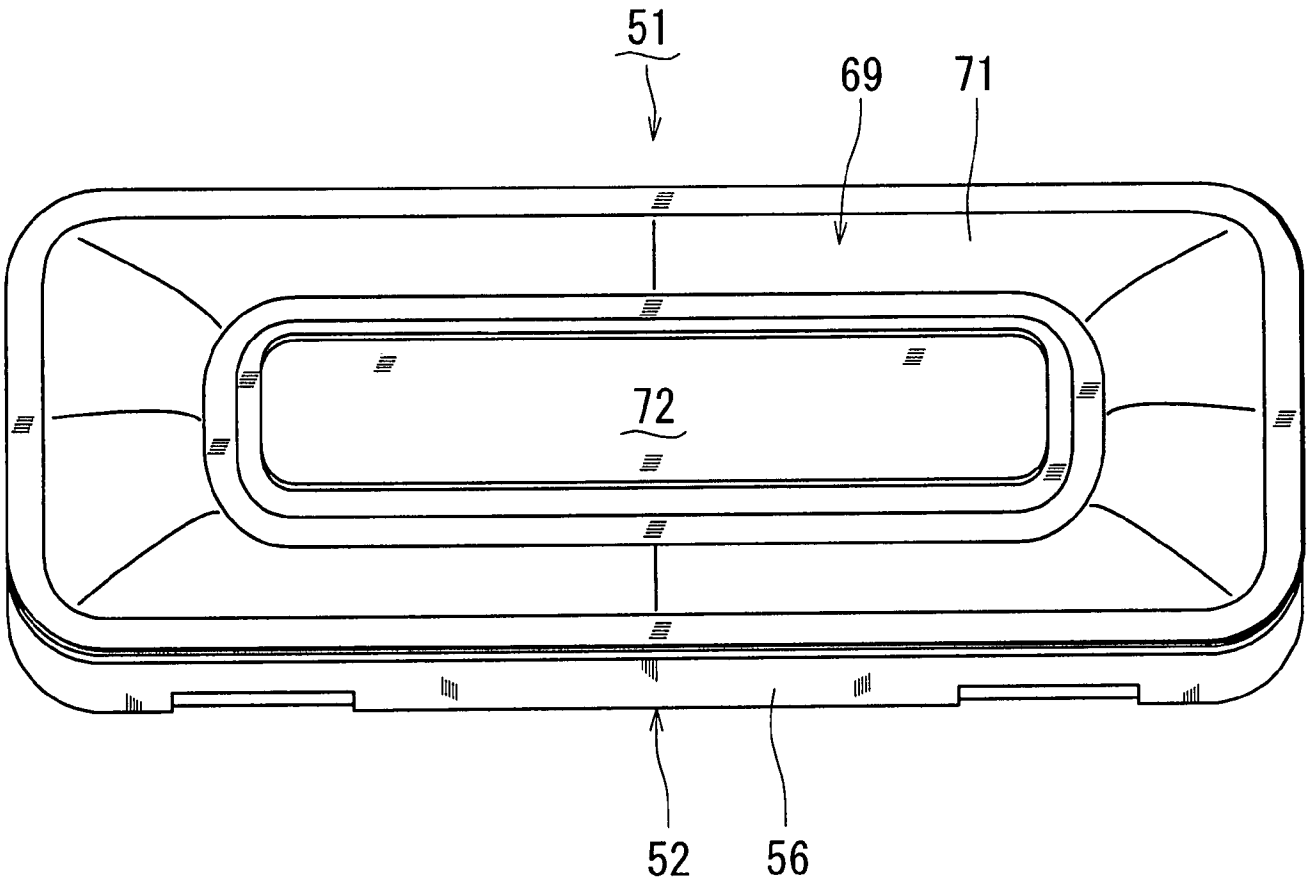
FIG. 9 is a plan view of a speaker of Embodiment 3 of the invention.
Figure 10:
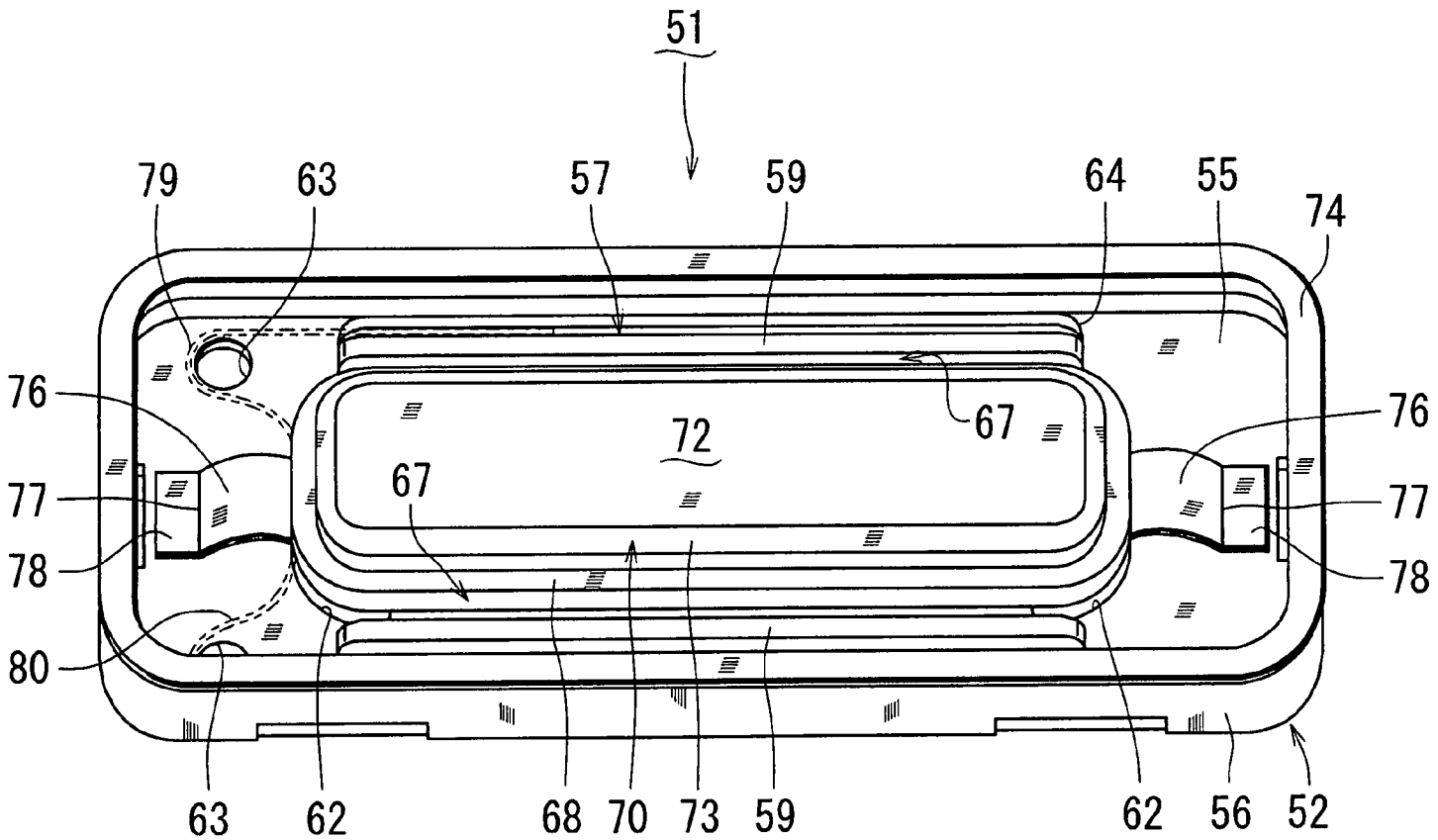
FIG. 10 is a plan view of a state where an edge portion of a diaphragm of the speaker of Embodiment 3 of the invention is made transparent.
Figure 11:
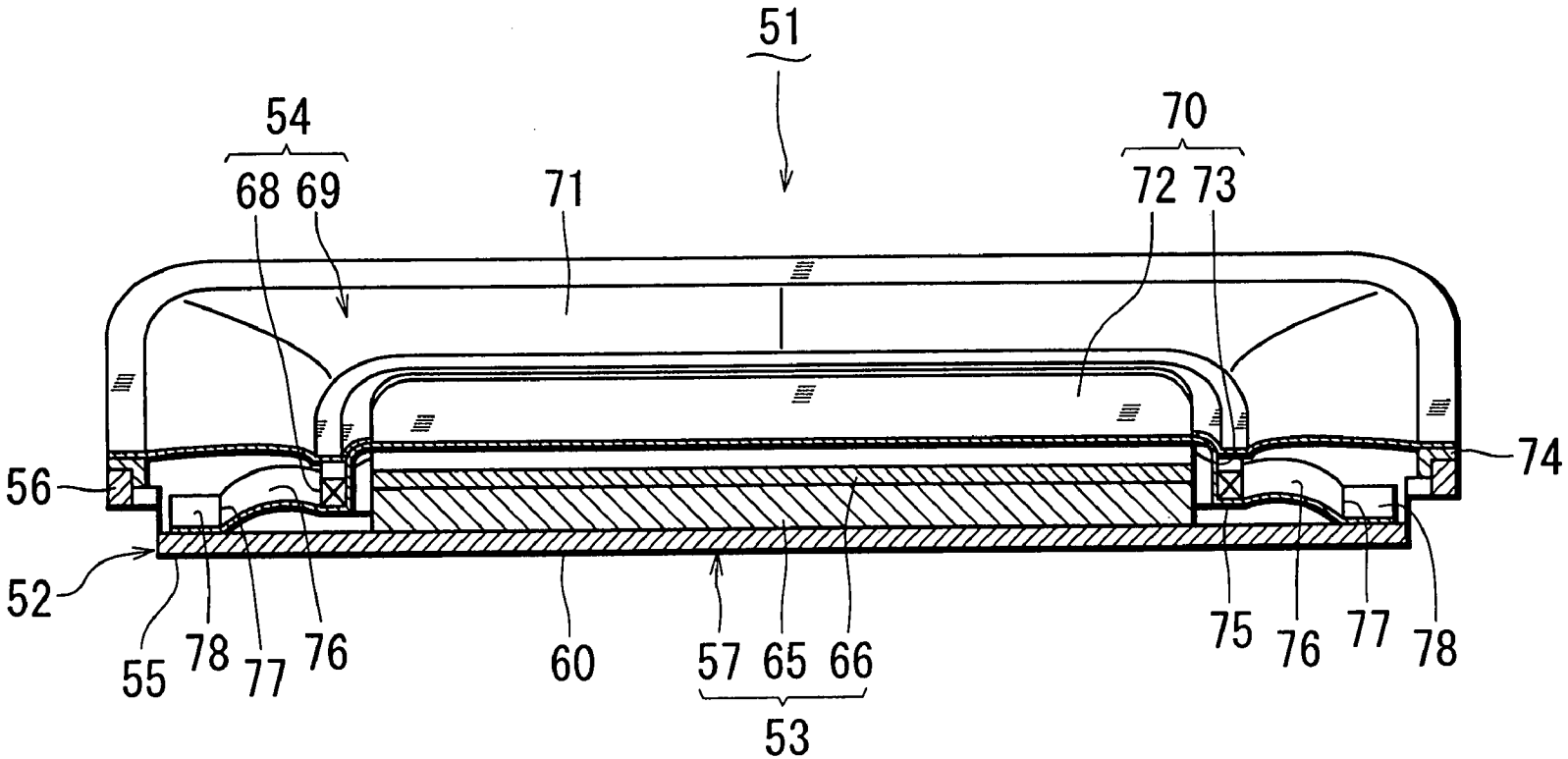
FIG. 11 is a sectional view of the speaker of Embodiment 3 of the invention.

A speaker of Embodiment 3 is shown in FIGS. 9 to 11. FIG. 9 is a plan view, FIG. 10 is a plan view of a state where an edge portion of a diaphragm is made transparent, and FIG. 11 is a sectional view.

The speaker 51 shown in FIGS. 9 to 11 has a rectangular shape, and realizes further miniaturization (reduction of the diameter) by means of forming the frame, magnetic circuit, and vibration system, which have a circular shape in the round speaker 1 of Embodiment 1, into a rectangular shape. The speaker 51 comprises a frame 52, magnetic circuit 53, and vibration system 54 which are rectangular.

The frame 52 is configured as a yoke-integral type, and formed into a shallow bottomed rectangular shape which is configured by applying a pressing process (drawing process) on one sheet-like metal material to dispose a rectangular bottom plate 55 and a sidewall 56 that is raised from the outer peripheral edge of the plate. Cutting and bending processes are performed on the bottom plate 55 to raise two portions or one and other longitudinal edge portions of the bottom plate 55, whereby a rectangular bottomed frame-like yoke 57 which is concentric with and slightly smaller than the frame 52 is integrally formed.

In the yoke 57, two parallel yoke sidewalls 59 which are opposed to the inside of the longitudinal sidewall 56 across a predetermined space, and a rectangular yoke bottom plate 60 which is configured by a middle portion of the bottom plate 55 that is inside the yoke sidewalls 59 are disposed.

The inside of the yoke 57 communicates with both longitudinal end portions in the frame 52 in the periphery of the yoke 57, between one end portions of the yoke side-walls 59, and the other end portions.

In the yoke bottom plate 60, jig insertion ports 62 each formed by a small L-like hole are opened respectively in the four corners of the plate. During assembling of the speaker 51, jigs (not shown) for positioning and holding a magnet 65 and pole piece 66 which will be described later, in the yoke 57 can be inserted from the lower side of the yoke 57 into the yoke 57 through the jig insertion ports 62.

In the bottom plate 55, other jig insertion ports 63 each formed by a small circular hole are opened respectively in the two corners of one longitudinal end side of the plate. During assembling of the speaker 51, other jigs (not shown) for forming lead wires 79, 80 (described later) of a voice coil 68 can be inserted from the lower side of the frame 52 into the frame 52 through the other jig insertion ports 63.

Two rectangular openings 64 which are formed by cutting and raising the yoke sidewalls 59 are disposed in the bottom plate 55. The openings 64 are used as rear sound holes for the speaker 51.

The magnetic circuit 53 is configured by: the yoke 57; the magnet 65 which is a rectangular columnar permanent magnet bonded and fixed onto the yoke bottom plate 60 while being centered thereon; and the pole piece 66 configured by a rectangular metal plate which is bonded and fixed onto the magnet 65 while being centered thereon.

In the magnetic circuit 53, linear magnetic gaps 67 are formed between the pole piece 66 and the yoke side-walls 59.

The vibration system 54 is configured by a rectangular tubular voice coil 68 in which a conductor wire is wound, and a diaphragm 69 to which the voice coil 68 is attached.

The diaphragm 69 is made of a resin film or a metal film, and configured by two pieces, or a center portion 70 and an edge portion 71.

The center portion 70 has a ceiled rectangular cylindrical shape. The ceiling portion configures a rectangular dome portion 72 in which the upper face is convex and the lower face is concave (or an inverted rectangular dome portion in which the upper face is concave and the lower face is convex). The trunk portion configures a rectangular tubular voice coil bobbin 73. The dome portion 72 and voice coil bobbin 73 which constitute a dome diaphragm are integrally formed.

The edge portion 71 has a rectangular annular shape. An inner peripheral edge portion is overlappingly bonded and fixed to an outer peripheral edge portion of the dome portion 72, so that the edge portion 71 is formed integrally with the periphery of the dome portion 72.

An outer peripheral edge portion of the edge portion 71 is bonded and fixed to an upper portion of the sidewall 56 through a rectangular annular diaphragm ring 74 which has an L-like section shape, and that of the dome portion 72 is joined to an outer portion of the frame 52, so that the dome portion 72 is always held to a correct position. The edge portion follows the motion of the dome portion 72 without impeding the motion of the dome portion, and blocks a sound of the back face of the dome portion 72.

The voice coil bobbin 73 hangs from the outer peripheral edge portion of the dome portion 72, an opening side end portion (lower end portion) is inserted into the magnetic gaps 67, and the longitudinal opposed edges of the voice coil 68 which is wound therearound are placed in the magnetic gaps 67. The piston motion (vertical motion) of the voice coil 68 is transmitted to the dome portion 72. The longitudinal width of the voice coil 68 is slightly larger than the width of the yoke sidewalls 59, and the both longitudinal end portions of the voice coil 68 are projected from between one end portions of the yoke sidewalls 59, and between the other end portions.

If the dome portion 72 and the voice coil bobbin 73 are formed separately from each other, a step of bonding them is necessary. In the embodiment, they are integrally formed, and hence such a step is not required. Furthermore, the center portion 70 and the edge portion 71 are formed separately from each other, and hence they can be formed by films of different materials, respectively, so that necessary characteristics can be easily obtained. Particularly, the voice coil bobbin 73 is requested to have characteristics such as: high rigidity which maintains the voice coil 68 to have a rectangular tubular shape in the narrow magnetic gaps 67, and which joins the voice coil 68 with the dome portion 72 without causing a loss; flexibility which prevents resonance from occurring; and heat resistance which resists the heat of the voice coil 68. Therefore, polyetherimide is used as the film material of the center portion 70.

The voice coil bobbin 73 is formed to have an L-like section shape, and has a rectangular annular flange portion 75 which is extended from the opening side end portion of the voice coil bobbin 73 to the outer side of the voice coil bobbin 73 in a plane perpendicular to the axis of the voice coil bobbin 73. A lower end portion of the voice coil 68 is bonded and fixed to the flange portion 75. The inner face and lower end of the voice coil 68 are held by the voice coil bobbin 73, whereby the voice coil 68 can be prevented from being loosened or dropping from the voice coil bobbin 73.

A plurality of dampers 76 are integrally formed on the voice coil bobbin 73. In order to allow the dampers 76 to be projected to the both longitudinal end portions in the frame 52 which are longitudinally outside the yoke 57, the dampers are configured by rectangular extended pieces which are extended in the longitudinal direction of the voice coil bobbin 73 from two places or a middle portion of one short side of the flange portion 75 and that of the other short side (i.e., middle portions of the opposed short edges of the flange portion 75), to the longitudinally outward side of the voice coil bobbin 73 in a plane perpendicular to the axis of the voice coil bobbin 73. In a tip end portion of each of the dampers 76, a bonding portion 78 is formed through a fold line 77.

In the dampers 76, the bonding portions 78 are bonded and fixed to middle portions of both longitudinally end portions of the bottom plate 55 which are in the longitudinally outward side of the yoke bottom plate 60, whereby the dampers 76 are arcuately bent to be provided with a spring property. As a result, the dampers 26 do not support the outer face of the voice coil bobbin 73, but support from the lower side the voice coil bobbin, hold the voice coil 68 to a correct position so that the voice coil can perform accurate piston motion, and follow the motion of the voice coil 68 without impeding the motion.

Lead wires 79, 80 of the voice coil 68 are drawn out from two places which are in a lower end portion of the voice coil 68, and which are in one short edge of the voice coil 68 that is close to the other jig insertion ports 63 for forming, respectively.

In the frame 52, plate-like rectangular insulators (not shown) are fixed to two places, or onto one end portions of the one and other openings 64 which are in the outer side portion of the bottom plate 55 in the periphery of the yoke bottom plate 60, and which are close to the other jig insertion ports 63 for forming.

The insulators are fixed to the frame 52 by passing fixing pins (not shown) which are raised from the bottom plate 55 by a burling process, through the insulators via through holes (not shown), and collapsing tip end portions of the fixing pins. Alternatively, the fixation may be performed by using an adhesive agent.

Contact pads (not shown), and external connection terminals (not shown) which are conductive with the contact pads, and which are configured by a plate spring or a coil spring are integrally formed in the insulators by insert molding. The contact pads are substantially flushly embedded in the upper faces of the insulators to be exposed into the frame 52. The external connection terminals are projected to the lower side of the frame 52 (the outside of the speaker 51) from the openings 64 which are below the insulators.

The lead wires 79, 80 drawn out from the voice coil 68 are further drawn out toward the corners on the longitudinal one end side of the frame 52 where the other jig insertion ports 63 are opened. In a state where the lead wires are taken around the jigs (round rods) inserted thereinto, a forming process is applied on the lead wires by pulling the lead wires toward the contact pads to which the lead wires are to be connected, and then a wire laying process of laying the lead wires to the contact pads to which the lead wires are to be connected is performed. Thereafter, the ends of the lead wires 79, 80 are spot-welded (or soldered) to the contact pads to which the lead wires are to be connected, to be electrically connected to the external connection terminals which are conductive with the connected contact pads. In this case, slacks are formed in the lead wires 79, 80 so that the lead wires 79, 80 do not impede the motion of the voice coil 68, and are not broken when a large current is input.

A shallow ceiled rectangular tubular baffle (not shown) which is configured by a metal sheet, and which has a front sound hole in the top face is fitted to the open upper face of the frame 52 (the front face of the speaker 51).

As described above, the speaker 51 comprises: the magnetic circuit 53 having the yoke 57, the magnet 65, and the pole piece 66; the vibration system 54 having the voice coil 68 and diaphragm 69 which are joined to each other through the voice coil bobbin 73; and the frame 52 which holds the magnetic circuit 53 and the vibration system 54, and the voice coil 68 is placed in the magnetic gaps 67. In addition, the dampers 76 which are extended from the plural places of the opening side end portion of the voice coil bobbin 73, and in which the tip end portions are bonded and fixed to the frame 52 are disposed. The frame 52 is formed into a bottomed tubular shape which is configured by applying a pressing process on one sheet-like metal material. The bottomed frame-like yoke 57 is formed by performing a cutting and raising process on at least two places of the bottom plate 55 of the frame 52, and configured as a yoke-integral type. The dampers 76 are extended to the outside of the yoke 57 through the gaps between the yoke sidewalls 59. The tip end portions of the dampers are bonded and fixed to the bottom plate 55 of the frame 52 which is in the periphery of the yoke bottom plate 60.

When an audio signal is supplied from an external circuit to the voice coil 68 through the pair of external connection terminals, the interaction between the magnetic field generated in the magnetic circuit 53 and the current flowing through the voice coil 68 causes the voice coil 68 to vertically vibrate, and, in accordance with this, the dome portion 72 (dome type diaphragm) is vertically vibrated to cause the surrounding air to vibrate, thereby generating a sound.

In this case, the dampers 76 correspond together with the edge portion 71 to the spring of the vibration system 54, reduce the vibration system stiffness (S0), and lower the minimum resonant frequency (f0) (make a low pitch sound to be easily generated). In spite that the speaker 51 is small, therefore, a high resistance to input is attained while the distortion is suppressed, and a high sound quality (low pitch sound) is maintained.

The dampers 76 support from the lower side the voice coil bobbin 73. Therefore, it is not necessary to additionally ensure a space for installing the dampers 76, and a high resistance to input is obtained without impairing the thinness of the small speaker 51.

The dampers 76 allow the air to flow through the gaps between the dampers 76, and hence the dampers 76 themselves are not required to have air permeability. Moreover, the dampers 76 support from the lower side the voice coil bobbin 73, and hence the dampers 76 can be formed integrally with the voice coil bobbin 73, irrespective of whether the voice coil bobbin 73 is formed separately from or integrally with the dome portion 72. Therefore, a high resistance to input can be obtained while suppressing the increase of the production cost of the small speaker 51.

In the dome portion 72 shown in the embodiment, a damper coupling plate which couples the bonding portions 78 of the dampers 76 together may be disposed as shown in Embodiment 2. In this case, the damper coupling plate has a rectangular annular shape.

DESCRIPTION OF REFERENCE NUMERALS

1, 41, 51 speaker
2, 52 frame
3, 53 magnetic circuit
4, 54 vibration system
5, 55 bottom plate
7, 57 yoke
9, 59 yoke sidewall
10, 60 yoke bottom plate
15, 55 magnet
16, 66 pole piece
17, 67 magnetic gap
18, 68 voice coil
19, 69 diaphragm
23, 73 voice coil bobbin
26, 76 damper
28, 78 bonding portion
42, 42*a* damper coupling plate

What is claimed is:

1. A speaker comprising: a magnetic circuit having a yoke, a magnet, and a pole piece; a vibration system having a voice coil and diaphragm which are joined to each other through a voice coil bobbin; and a frame which holds said magnetic circuit and said vibration system, said voice coil being placed in a magnetic gap, wherein dampers which are extended respectively from a plurality of places of an opening side end portion of said voice coil bobbin are disposed, tip end portions of said dampers being bonded and fixed to said frame.

2. A speaker according to claim 1, wherein said frame is formed into a yoke-integral type by applying a pressing process on one sheet-like metal material to form a bottomed tubular shape, and by cutting and raising at least two places of a bottom plate of said frame to form a bottomed frame-like yoke, said dampers are extended to an outside of said yoke through gaps between sidewalls of said yoke, and tip end portions of said dampers are bonded and fixed to said bottom plate of said frame which is in a periphery of a bottom plate of said yoke.

3. A speaker according to claim 1, wherein an annular damper coupling plate which couples said tip end portions of said dampers together is disposed.

4. A speaker according to claim 1, wherein an annular damper coupling plate which couples said tip end portions of said dampers together is disposed separately from said dampers, and said dampers are bonded and fixed to said frame through said damper coupling plate by bonding and fixing said tip end portions of said dampers to said damper coupling plate.

5. A speaker according to claim 1, wherein an annular damper coupling plate which couples said tip end portions of said dampers together is disposed integrally with said dampers, and said dampers are bonded and fixed to said frame through said damper coupling plate.

* * * * *